US011071366B2

(12) United States Patent
Capell

(10) Patent No.: US 11,071,366 B2
(45) Date of Patent: Jul. 27, 2021

(54) RAZOR DRYING CONTAINER

(71) Applicant: David Capell, Benton City, WA (US)

(72) Inventor: David Capell, Benton City, WA (US)

( * ) Notice: Subject to any disclaimer, the term of this patent is extended or adjusted under 35 U.S.C. 154(b) by 121 days.

(21) Appl. No.: 16/550,825

(22) Filed: Aug. 26, 2019

(65) Prior Publication Data

US 2019/0374002 A1 Dec. 12, 2019

Related U.S. Application Data

(60) Provisional application No. 62/725,401, filed on Aug. 31, 2018.

(51) Int. Cl.
*A45D 27/48* (2006.01)
*A45D 27/22* (2006.01)

(52) U.S. Cl.
CPC ..... *A45D 27/48* (2013.01); *A45D 27/22* (2013.01)

(58) Field of Classification Search
CPC ..... A45C 11/00; A45C 11/04; A45D 27/22; A45D 27/24; A45D 27/46; A45D 27/48; B65D 81/24
USPC ..... 15/104.92, 106; 30/541; 206/208, 209, 206/349–355; 220/4.26, 4.27; 211/13.1–85.14, 14–70.8
See application file for complete search history.

(56) References Cited

U.S. PATENT DOCUMENTS

| | | | | |
|---|---|---|---|---|
| 4,429,786 | A * | 2/1984 | Hucal | A45C 11/005 220/4.27 |
| 5,938,058 | A * | 8/1999 | Kim | A45C 11/008 220/4.26 |
| 7,858,027 | B2 * | 12/2010 | Trissel | A45D 27/46 206/352 |
| 8,584,837 | B1 | 11/2013 | Mather | |
| 8,883,075 | B2 | 11/2014 | Henry et al. | |
| 9,743,739 | B2 | 8/2017 | Parisi et al. | |
| 2007/0012693 | A1 * | 1/2007 | Kummer | B65D 43/0231 220/4.27 |
| 2011/0225834 | A1 | 9/2011 | Cirilli | |
| 2015/0059197 | A1 | 3/2015 | Sassano | |

* cited by examiner

*Primary Examiner* — Bryon P Gehman
(74) *Attorney, Agent, or Firm* — Boudwin Intellectual Property; Daniel Boudwin

(57) ABSTRACT

A razor drying container. The razor drying container includes a housing. The housing is defined by a base and a first sidewall that extends upward from the base. The first sidewall defines a first open end. A first diaphragm is mounted on the first open end. The first diaphragm has a first slot. The first open end defines an interface for the second sidewall. The second sidewall forms a second open end. A second diaphragm is formed on the second open end. The second diaphragm includes a second slot.

14 Claims, 3 Drawing Sheets

RAZOR DRYING CONTAINER

CROSS REFERENCE TO RELATED APPLICATIONS

This application claims the benefit of U.S. Provisional Application No. 62/725,401 filed on Aug. 31, 2018. The above identified patent application is herein incorporated by reference in its entirety to provide continuity of disclosure.

BACKGROUND OF THE INVENTION

The present invention relates to a razor drying container. More specifically, the present invention provides a container for storing, drying and, potentially, sanitizing a reusable razor.

Many people use razors to shave facial hair and body hair. Although many razors are disposable, some handheld razors can be reused. Over time, however, dirt and debris residue, and oxidation may build up on razor blades. When this happens, the razor blades may become dull, as well as unsanitary. Dull razor blades are not only inconvenient, but they are also dangerous. Not only is shaving with a dull razor blade ineffective, but may also lead to serious injuries to the part of the body that is being shaved.

Razors and razor blades are expensive. It can become extremely cost prohibitive to purchase a new razor or razor blade after a couple of shaving sessions. Specifically individuals living on a tight budget are unable to purchase a new razor or razor blades regularly.

In order to sanitize the razor or razor blade, some individuals may insert an entire razor or razor blade into a container that contains alcohol. However, this is not a good solution to the problem of unsanitary razors, as some parts of the razor, non-metallic parts specifically, may degrade in the alcohol solution. Despite the frugal intentions, this process normally results in the need to purchase a new razor. As such, there is a defined need amongst the known art for a device that enhances the reusability of razors.

SUMMARY OF THE INVENTION

In view of the foregoing disadvantages inherent in the known types of razor storage and cleaning devices now present in the prior art, the present invention provides a razor drying container wherein the same can be utilized for providing convenience for the user when airing out a reusable razor.

The present system comprises a housing. The housing is defined by a base and a first sidewall that extends upward from the base. The first sidewall defines a first open end. A first diaphragm is mounted on the first open end. The first diaphragm has a first slot. The first open end defines an interface for the second sidewall. The second sidewall forms a second open end. A second diaphragm is formed on the second open end. The second diaphragm includes a second slot.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
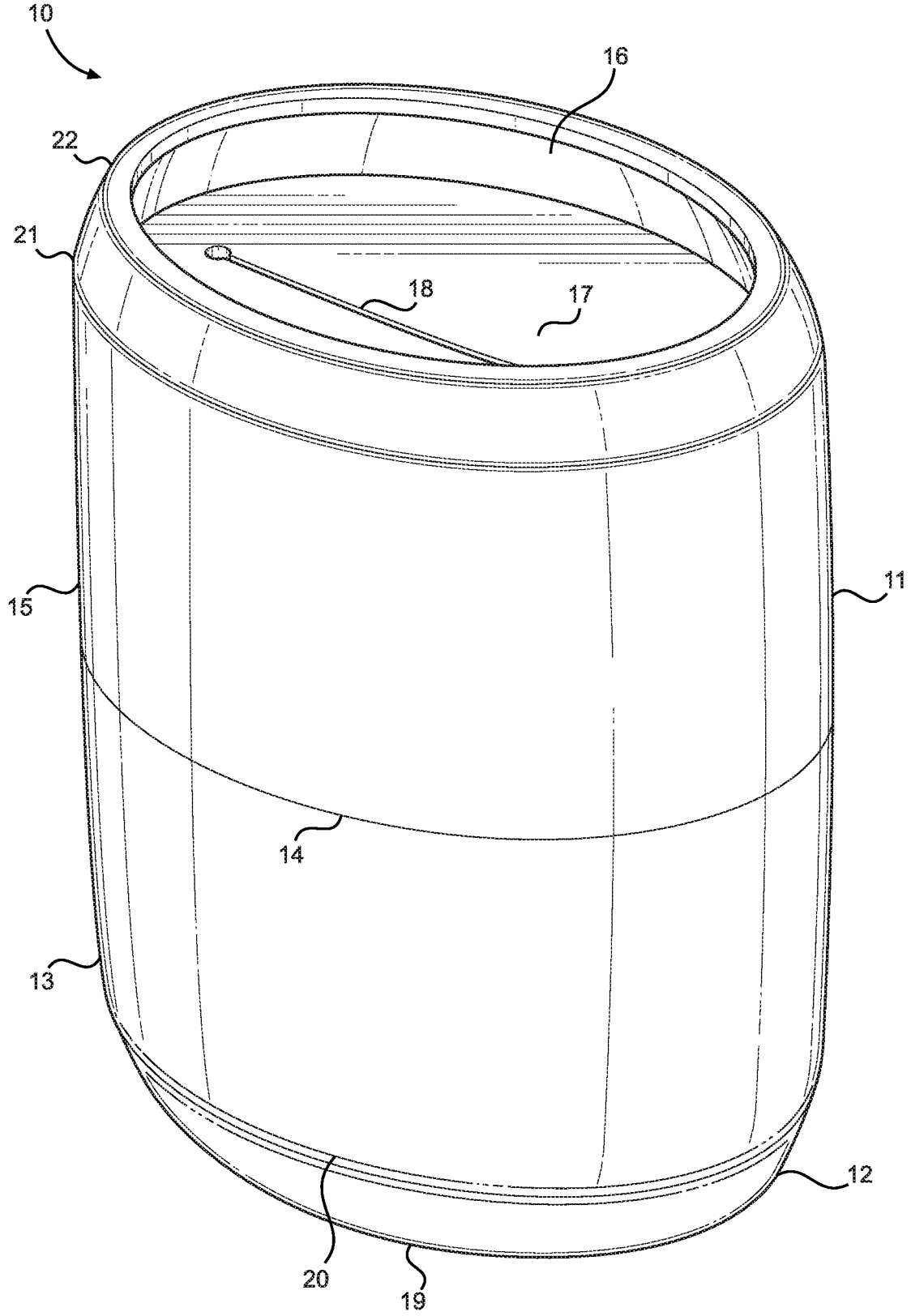
FIG. 1 shows a perspective view of an embodiment of the razor drying container.

Reference is made herein to the attached drawings. Like reference numerals are used throughout the drawings to depict like or similar elements of the razor drying container. The figures are intended for representative purposes only and should not be considered to be limiting in any respect.

Referring now to FIG. 1, there is shown a perspective view of an embodiment of the razor drying container. The razor drying container 10 comprises a housing 11. The housing 11 is defined by a base 12 with a first sidewall 13 extending upward therefrom. The first sidewall 13 defines a first open end (illustrated in FIG. 2 and FIG. 3). In the illustrated embodiment, the base 12 is planar. As such, the razor drying container 10 is able to sit upright upon a flat surface. In the illustrated embodiment, the housing 11 is circular, such that no corners or edges are defined thereby.

The first open end defines an interface 14. The interface 14 is configured to removably receive a second sidewall 15. The second sidewall 15 is of an identical perimeter to the first sidewall 13, such that the interface 14. It is an object of the present invention to provide a seamless interface between the first sidewall 13 and the second sidewall, such that the external surface of the razor drying container 10 is entirely smooth and without seams. Furthermore, in one embodiment, the interface 14 between the first sidewall 13 and the second sidewall 15 forms a watertight and an airtight seal, such as to reduce the risk of dust or debris from entering the housing 11 and forming mold or mildew.

The second sidewall 15 defines a second open end 16. The second open end 16 provides access to an internal cavity defined by the housing 11. The internal cavity extends fully from the second sidewall 15 to the first sidewall 13 and the base 12. As illustrated, the second open end 16 comprises a second diaphragm 17. The second diaphragm 17 comprises a second slot 18 disposed therein. The second slot 18 is configured to removably receive an elongated object, such as a shaving razor, therein and to hold the elongated object in a fixed position.

In the illustrated embodiment, the first sidewall 13 is tapered outward from a bottom 19 to a top portion 20 of the first sidewall. In the illustrated embodiment, the top portion 20 is disposed closer to the base 12 than it is to the interface 14. As such, greater volume within the housing 11 is provided without increasing the surface area of the base 12, which would take up additional counter space, for example. In a further embodiment, the second sidewall 15 is tapered in inwardly from a bottom portion 21 to a top 22 thereof, such that the second open end 16 is smaller in diameter than a diameter defined by the remaining portion of the second sidewall 15. As such, an inward lip is defined that assists in the prevention of dirt and debris from entering the housing 11.

Figure 2:
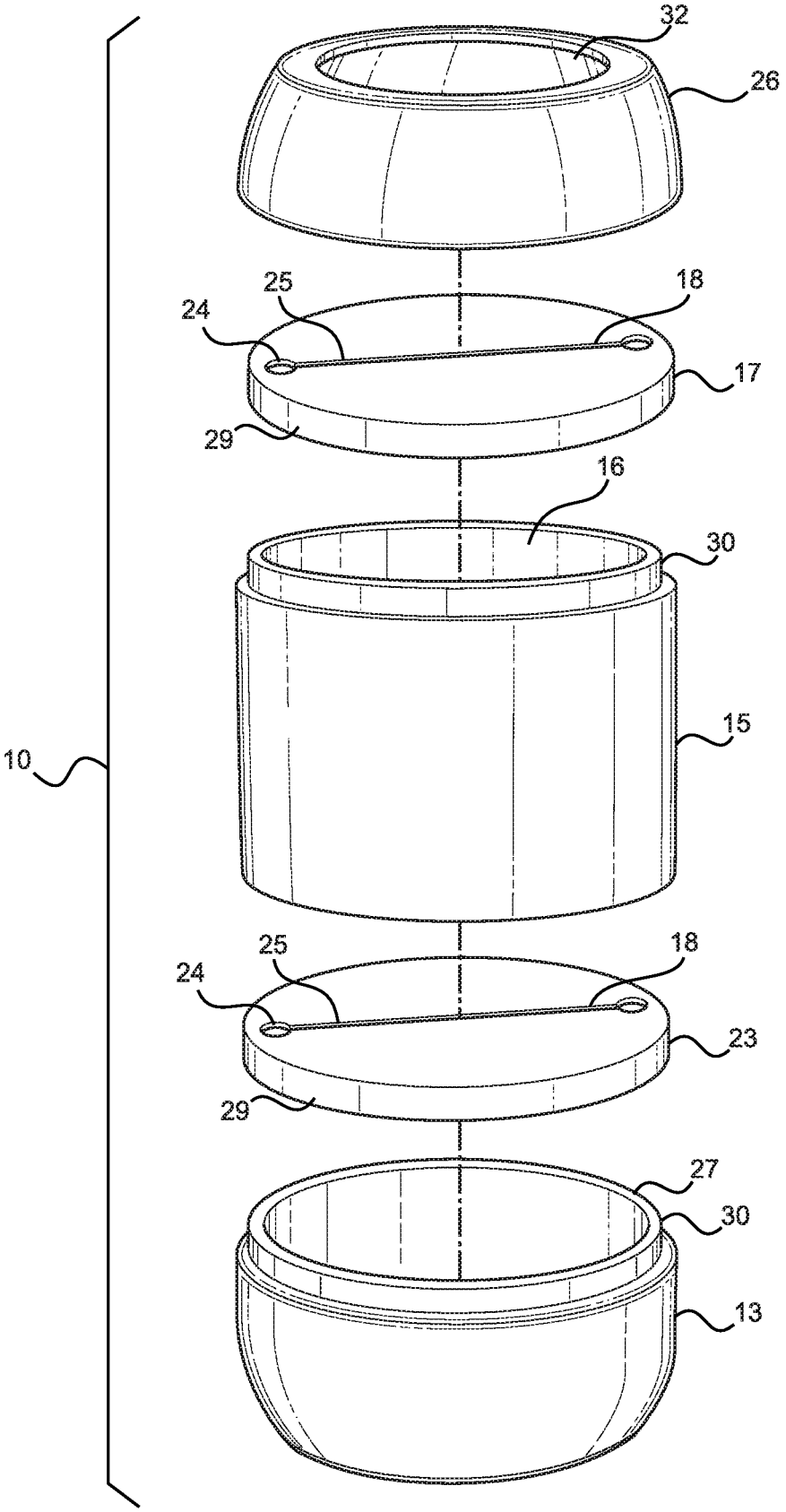
FIG. 2 shows an exploded view of an embodiment of the razor drying container.

Referring now to FIG. 2, there is shown an exploded view of an embodiment of the razor drying container. As illustrated, the razor drying container 10 comprises the base 12 with the first sidewall 13 extending upward therefrom. The first open end 27 is dimensioned to receive a first diaphragm 23. In the illustrated embodiment, the first diaphragm 23 comprises a first slot 28. The first slot 28 is configured to removably receive an elongated object, such as a shaving razor, therein and to hold the elongated object in a fixed position. In conjunction with the second slot 18, a shaving razor can be stored such that a first end of the shaving razor is secured in the first slot 28 and the second end of the shaving razor is secured in the second slot 18. As such the shaving razor is more effectively secured.

Furthermore, in the illustrated embodiment, the first slot 28 and the second slot 18 comprise a pair of apertures 24 with a linear opening 25 defined therebetween. As such, flexibility of the first slot 28 and the second slot 18 is enhanced such as to receive a larger object, such as a shaving razor with an enlarged handle. The first slot 28 and the second slot 18 are biased in a resting position (as illustrated), but are expanded when an object is placed therebetween. In another embodiment, the first slot 28 and the second slot 18 are tensioned such that they are liquid impermeable when in a resting position. It is an object of at least one embodiment of the present invention to provide a first slot 28 and a second slot 18 that are dimensioned to receive the head of a shaving razor.

In the illustrated embodiment, each of the first diaphragm 23 and the second diaphragm 17 comprises a lip 29 extending downward therefrom. The lip 29 is configured to secure the first diaphragm 23 and the second diaphragm 17 to the first sidewall 13 and the second sidewall 15 respectively. In the shown embodiment, each of the first sidewall 13 and the second sidewall 15 define a receiver 30, wherein each receiver 30 is dimensioned to receive each lip 29 of the first diaphragm 23 and the second diaphragm 17 respectively. Each receiver 30 is shown to be a circular section of each of the first sidewall 13 and the second sidewall 15 that is defined by a smaller perimeter. The connection between each lip 29 and each receiver 30 is such that dust or debris is prevented from entering the seam between the first sidewall 13 and the second sidewall 15.

In some embodiments, the razor drying container further comprises a cap 26. The cap 26 is removably disposable on the second open end 16. In the illustrated embodiment, the cap 26 comprises a cavity 32, such that an object, such as a shaving razor, can be inserted into the housing. In such an embodiment, the second diaphragm 17 is disposed beneath the cavity 32, such as to prevent dust or debris from entering the housing. In alternate embodiments, the cap 26 does not include a cavity 32 and would need to be removed in order to provide access to the housing. In the illustrated embodiment, the cap 26 is tapered toward the cavity 32, such that the cavity is of a lesser perimeter than the first sidewall 13 and the second sidewall 15, thus reducing the open space through which the housing is accessible.

Figure 3:
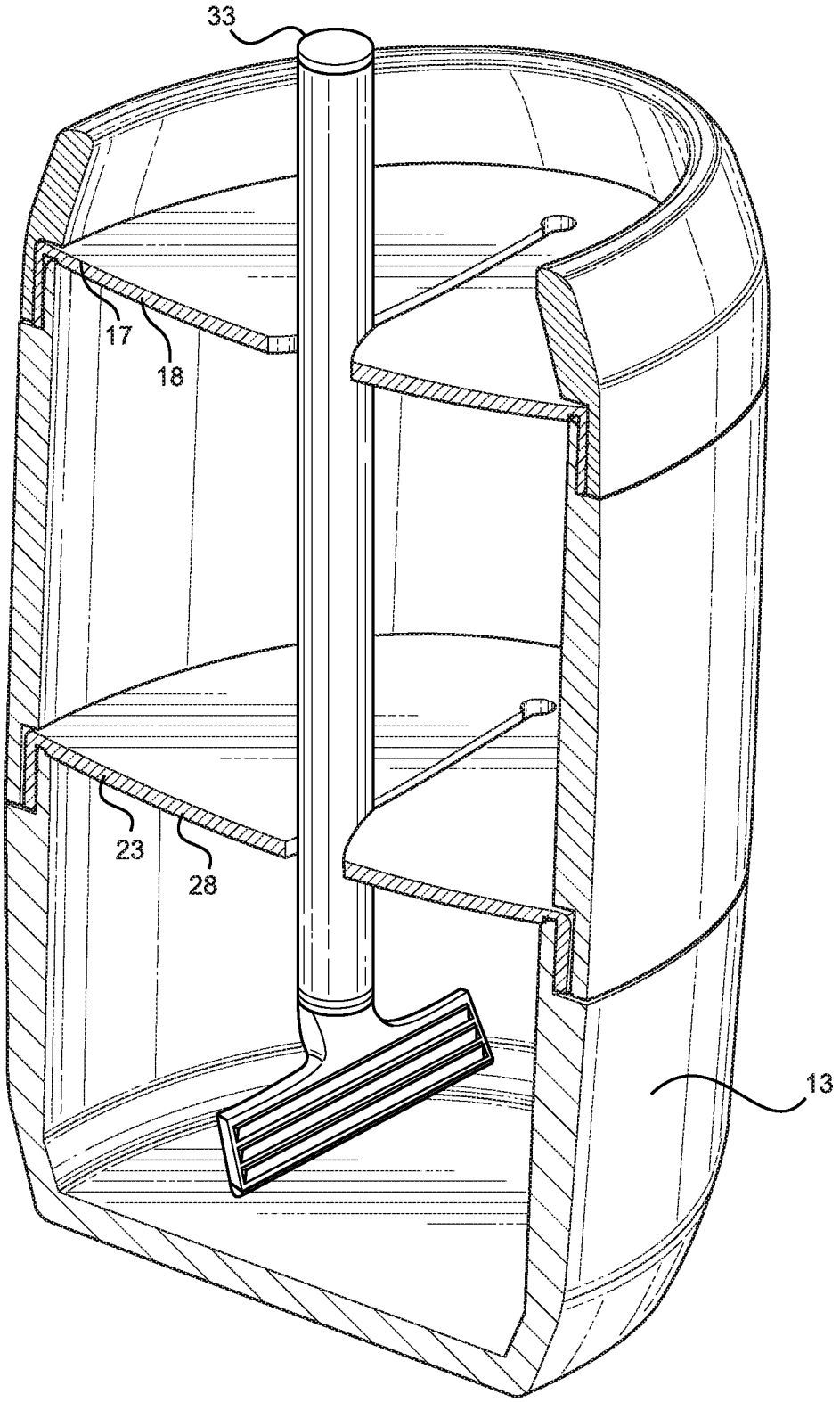
FIG. 3 shows a cross-sectional view of an embodiment of the razor drying container in use.

Referring now to FIG. 3, there is shown a cross-sectional view of an embodiment of the razor drying container in use. In use, a shaving razor 33 or other elongated item may be inserted into the housing. In the illustrated embodiment, the shaving razor 33 is inserted head first, such that the head of the shaving razor 33 is disposed in the housing defined by the first sidewall 13. The shaving razor 33 extends through the first diaphragm 23 and the second diaphragm 17 through the first slot 28 and the second slot 18 respectively. In one embodiment, a sanitizing fluid is disposed in the housing defined by the first sidewall 13. As such, a shaving razor 33 can be sanitized when inserted head first into the razor drying container. In one embodiment, the sanitizing fluid is an alcohol solution.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A razor drying container, comprising:
a housing;
the housing defined by a base and a first sidewall extending upwardly therefrom;
the first sidewall defining a first open end;
a first diaphragm disposed upon the first open end;
the first diaphragm having a first slot;
the first open end defining an interface;
the interface configured to removably receive a second sidewall;
the second sidewall defining a second open end;
a second diaphragm disposed upon the second open end;
the second diaphragm having a second slot.

2. The razor drying container of claim 1, wherein the base is planar.

3. The razor drying container of claim 1, wherein the first sidewall tapers outward from a bottom to a top portion thereof.

4. The razor drying container of claim 1, wherein the second sidewall tapers inward from a bottom to a top thereof.

5. The razor drying container of claim 1, wherein the interface between the first sidewall and the second sidewall forms a seal.

6. The razor drying container of claim 1, wherein a sanitizing fluid is disposed in the housing.

7. The razor drying container of claim 1, wherein the first diaphragm and the second diaphragm are liquid impermeable when in a resting position.

8. The razor drying container of claim 1, wherein the first slot and the second slot are dimensioned to receive a head of a razor.

9. The razor drying container of claim 1, wherein a cap is removably disposed on the second open end.

10. The razor drying container of claim 9, wherein the cap is tapered.

11. A razor drying container, comprising:
a housing;
the housing defined by a base and a first sidewall extending upwardly therefrom;
the base being planar;
the first sidewall defining a first open end;
the first sidewall tapering outward from a bottom to a top portion thereof;
a first diaphragm disposed upon the first open end;
the first diaphragm having a first slot;
the first diaphragm being liquid impermeable when in a resting position;

the first slot dimensioned to receive a head of a razor;

the first open end defining an interface;

the interface configured to removably receive a second sidewall;

the top of the first sidewall being identical in shape and size to the bottom of the second sidewall;

the second sidewall defining a second open end;

the second sidewall tapering inward from the bottom to a top portion thereof;

a second diaphragm disposed upon the second open end;

the second diaphragm having a second slot;

the second diaphragm being liquid impermeable when in a resting position;

the second slot dimensioned to receive a razor;

a cap removably disposed on the second open end.

12. The razor drying container of claim 11, wherein the interface between the first sidewall and the second sidewall forms a seal.

13. The razor drying container of claim 11, wherein a sanitizing fluid is disposed in the housing.

14. The razor drying container of claim 11, wherein the cap is tapered.

* * * * *